United States Patent [19]

Gebert

[11] 4,064,631

[45] Dec. 27, 1977

[54] SEWING TAPE

[76] Inventor: Kineko Gebert, 301-G Park Hill Drive, Pewaukee, Wis. 53072

[21] Appl. No.: 726,426

[22] Filed: Sept. 24, 1976

Related U.S. Application Data

[63] Continuation-in-part of Ser. No. 618,084, Sept. 30, 1975, abandoned, which is a continuation-in-part of Ser. No. 467,342, May 6, 1974, abandoned, which is a continuation-in-part of Ser. No. 333,961, Feb. 20, 1973, abandoned.

[51] Int. Cl.[2] ..... A41H 1/00

[52] U.S. Cl. ..... 33/2 R; 428/156; 33/137 R

[58] Field of Search ..... 33/2 R, 12, 17 R, 137 R; 112/136; 223/34, 50; 428/131, 156

[56] References Cited

U.S. PATENT DOCUMENTS

| | | | |
|---|---|---|---|
| 230,937 | 8/1880 | Hammond | 33/17 R |
| 748,174 | 12/1903 | Dunlea | 33/137 R |
| 2,778,113 | 1/1957 | Norman | 33/137 R |
| 2,805,485 | 9/1957 | Krummel | 33/2 R |
| 3,454,203 | 7/1969 | Nelson | 33/137 R X |
| 3,794,554 | 2/1974 | Caring | 33/2 R X |
| 3,797,120 | 3/1974 | Byne | 33/137 R |

FOREIGN PATENT DOCUMENTS

| | | | |
|---|---|---|---|
| 134,835 | 7/1902 | Germany | 33/137 R |

*Primary Examiner*—Charles E. Phillips
*Attorney, Agent, or Firm*—Andrus, Sceales, Starke & Sawall

[57] ABSTRACT

An improved sewing tape is formed of an unperforated strip of soft pliant paper having a textured surface for retaining the tape on a fabric. A seam locating line runs down the tape and normal to transverse measuring lines. Additional lines, parallel to the seam locating line, form a pattern of squares with the transverse lines for use in carrying out decorative stitching.

9 Claims, 4 Drawing Figures

SEWING TAPE

CROSS REFERENCE TO RELATED APPLICATION

The present application is a continuation-in-part application of copending application Ser. No. 618,084 filed Sept. 30, 1975 and now abandoned, which application is a continuation-in-part application of prior application Ser. No. 467,342 filed May 6, 1974 and now abandoned, which application is a continuation-in-part application of prior application 333,961 filed Feb. 20, 1973 and now abandoned.

BACKGROUND OF THE INVENTION

Field of the Invention

The present invention relates to a multiple purpose tape useful as a sewing aid.

SUMMARY OF THE PRESENT INVENTION

Sewing tapes of the type to which the present invention relates have been heretofore employed to measure fabric or seam dimensions and/or guide a sewing machine operator in positioning a seam in the fabric. The tape is applied to the fabric at the desired location and remains there as the fabric is fed through the machine. During the sewing, appropriate markings on the tape assist the operator. After sewing, the tape is usually removed by tearing the tape along the line of stitching.

One available type of sewing tape is formed of tissue paper having the characteristic stiffness, brittleness and hard exterior surface properties. The brittleness and hard surface make it difficult to retain the tape on the fabrics during the handling accompanying sewing. The paper is, therefore, perforated in an effort to improve its retention properties. Such a tissue paper tape is sold by the Belding-Hemingway Company of New York, New York.

In other sewing tapes, adhesive or other treatment is applied to a surface of the tape. Such techniques tend to be costly in a product which is of a single usage, disposable, nature.

It is therefore the object of the present invention to provide an improved sewing tape which avoids the need for adhesives or perforations for adhering the tape to the fabric. It is a further object of the present invention to provide an improved sewing tape which may be used to form a decorative stitching and the like on fabrics.

The present invention lies in the provision of a sewing tape having sufficient pliancy and surface texture to retain the tape on the fabric without perforation or adhesive. The tape may be formed of paper toweling and the texturing may typically comprise a plurality of depressions in the surface. A longitudinal seam locating line runs down the tape. In the preferred embodiment of the invention this line may be spaced from one edge of the tape the amount by which a sewing seam is located from the edge of a piece of fabric. A plurality of lines normal to the one longitudinal edge of the tape are provided for measuring purposes. Additional longitudinal lines are provided to form squared patterns which may be used as an aid in creating decorative stitching on the fabric.

DESCRIPTION OF THE PREFERRED EMBODIMENT

Figure 1:
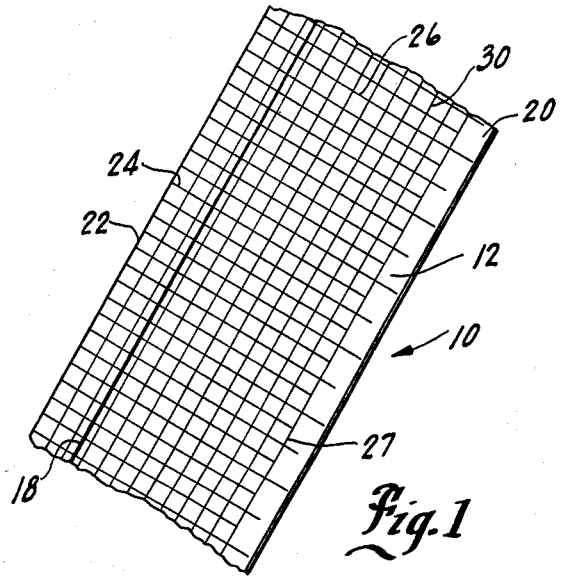
FIG. 1 is a perspective view showing the sewing tape of the present invention.

Referring now to FIG. 1 there is shown therein sewing tape 10 of the present invention comprised of an unperforated elongated strip of material 12. Sewing tape 10 may typically be 1 ¾ inches wide and stored in a roll dispenser or the like. The properties of material 12 are described, infra.

A longitudinal seam locating line 18 on surface 20 runs the length of sewing tape 10. This line is preferably spaced from longitudinal edge 22 by a distance equal to the normal location of a sewn seam from the edge of a piece of fabric. Thus, line 18 is typically spaced from edge 22 a distance of ⅝th inch.

A plurality of measuring lines 24 are also provided on the surface of tape 10 normal to longitudinal edge 22. Measuring lines 24 may be spaced apart by a convenient unit of measurement. Selected ones of the lines 26 may extend beyond line 27 adjacent the other edge of the tape to indicate the major incremental units of measurement, such as half inches.

Figure 3:
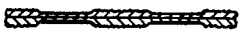
FIG. 3 is a cross-sectional view taken along the line 3—3 of FIG. 2.

Material 12 is a pliant or limp paper product, preferably ordinary household paper toweling. Such paper is typically non rustling and desirably has sufficient resistance to tearing to permit normal usage while allowing removal after sewing, as hereinafter described. Material 12 may be either single ply or two ply, the latter being preferred, as shown in FIG. 3, because of its tear resistance properties. In commerce, paper toweling is customarily specified by "basis weight"; that is, the weight of a given number of sheets, most commonly a ream or 500 sheets. The sheets measure 24 inches by 36 inches. The term "weight" or "basis weight" bears a similar connotation in this specification and its claims. The weight of paper towelling may range between 28 and 32 pounds with household paper towelling typically having a basis weight of 30 to 32 pounds.

Figure 2:
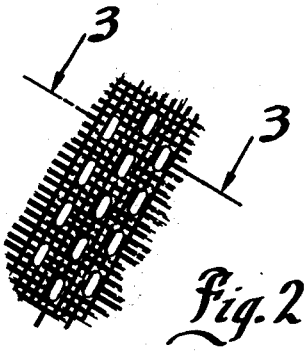
FIG. 2 is a partial detailed view of a portion of the sewing tape of the present invention showing the texturing of the surface thereof.

Paper towelling has a soft surface characterized by an absence of calendaring or filling. The surface may be textured by the wires of the paper machine. While these surface properties retain the material on the fabric, the retention properties are enhances by a further texturizing of the surface of the towelling. This typically includes a greater or lesser degree of wrinkling or dimpling of the surface which greatly increases the adherence of tape 10 to the fabric without altering its dimensional stability. See FIGS. 2 and 3 showing dimples.

Tests have been conducted to quantify the retention properties of the household paper towelling described above and to illustrate the improvement of a sewing tape so formed over the commercially available tissue paper sewing tape. In the tests, tapes of both types were laid on various types of fabrics and the weight required to displace the tape along the surface of the fabric determined. Tests were conducted with no external force urging the tape into abutment with the surface of the fabric, i.e., with the tape merely lying on the surface of the fabric. Tests were also conducted under conditions which a force was applied to the tape to force it onto the fabric. These latter tests simulate conditions arising during the actual handling of the tape in use.

The results of the tests in which no weight was applied to the tapes are as follows; the figures are grams of force required to dislodge a 7 inches by 1⅜ inches sample from various fabric surfaces.

| Tape Type | Hard Finish Broad Cloth | Silk | Velvet |
|---|---|---|---|
| tissue sewing tape | .57 gm | .57 gm | 1.13 gm |
| towel tape #1 | 2.83 gm | 1.98 gm | 4.24 gm |
| towel tape #2 | 1.98 gm | 1.98 gm | and more than 5.65 gm |

The results of the tests in which the weight was applied to the tape to force it onto the fabric are as follows; the figures are grams of force required to displace a 7 inches by 1 ⅜ inches sample from various fabric surfaces when the tape is forced on the fabric surface with the weight shown.

| Tape Type | Hard Finish Broad Cloth (15.4 gm wt) | Silk (15.4 gm wt) | Velvet (3.07 gm wt) |
|---|---|---|---|
| tissue sewing tape | 15.4 gm | 6.14 gm | 6.14 gm |
| towel ape #1 | 61.4 gm | 15.4 gm | 58.4 gm |
| towel tape #2 | 46.1 gm | 15.4 gm | 76.79 gm |

Towel tape #1 used in the above tests was formed from towelling made and sold by the Scott Paper Company of Philadelphia, Pennsylvania under the trademark "Viva". Towel tape #2 was formed from towelling made and sold by Charmin Paper products (Proctor & Gamble) of Cincinnati, Ohio under the trademark "Bounty".

In use, sewing tape 10 is placed on the two fabrics to be sewn with surface 20 exposed. The edge of the tape is aligned with the edge of the fabric layers. The tape and fabric layers are fed into a sewing machine with line 18 directly below the sewing machine needle. The machine is then operated to sew the two layers of fabric together along with the tape on line 18. Line 18 acts as a guide for the location of the seam while measuring lines 24 provides the sewing machine operator with a guage for ascertaining the length of the sewn seam, as well as the placing of stitches for more perfect hemming. When the sewing operation is complete, the fabric layers and tape are removed from the machine. Tape 10 may be removed by tearing along the line of stitching. Tape 10 is also suitable for use in hand sewing.

As noted in the tables above, tape 10 particularly facilitates the sewing of hard-to-sew materials, such as velvets, silks, etc. It also facilitates the sewing of difficult items such as zippers by preventing slippage of the materials, due to the textured surface of paper 12, when the tape is placed under the materials. It also prevents the stretching and pulling of fabrics such as knits and yarn goods by holding the material firm, thereby eliminating the need for an embroidery ring.

Figure 4:
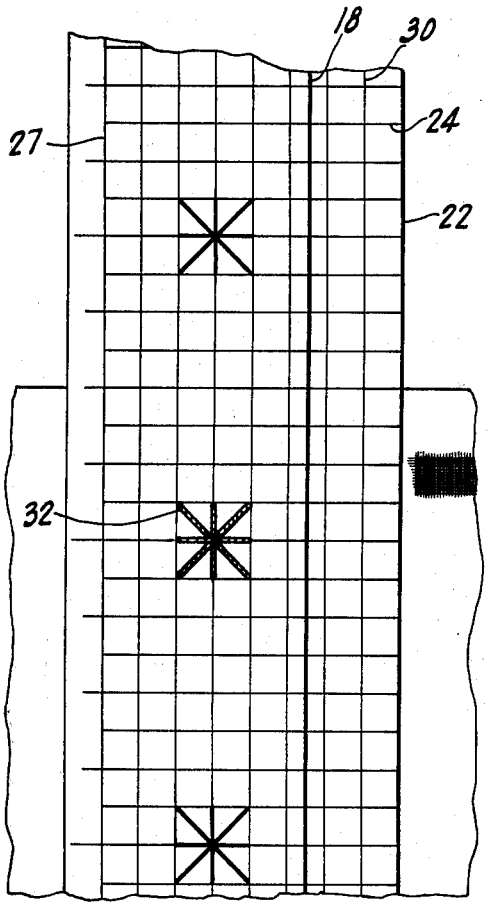
FIG. 4 is a partial plan view of the sewing tape of the present invention showing the tape in use.

A plurality of longitudinal lines 30 are also provided on tape 10 as shown in FIGS. 1 and 4. The spacing of the longitudinal lines 30 and the spacing of normal or transverse lines 24 is preferably identical so that a squared pattern is formed on the surface of the tape. It has been found desirable to space both the transverse lines and the longitudinal lines by a quarter of an inch so that the grid of quarter inch squares is formed. Seam line 18 may be distinguished from other longitudinal lines 30 by width, color, etc.

The grid so formed may be employed as an aid in forming a wide variety of individual or duplicate decorative patterns on the surface of the fabric. The desired design is sketched on the surface of the tape, as shown in the upper portion of FIG. 4. Thereafter, the tape is placed on the surface of the fabric and needle work performed to apply stitches 32 shown in the bottom portion of FIG. 4 to form the decorative design. At the conclusion of the needlework the pattern is removed by tearing it along the stitches. The grid also may be used to form designs which may subsequently be transferred to material such as felt or plastic by placing carbon and tracing paper beneath the paper tape and tracing the designs. The tracing is then placed on a piece of fabric which is cut along the transferred design.

Various modes of carrying out the invention are contemplated as being within the scope of the following claims particularly pointing out and distinctly claiming the subject matter which is regarded as the invention.

I claim:

1. A tape for use in the sewing of fabrics comprising an elongated unperforated strip of paper, said strip comprising paper towelling having sufficient pliancy and exterior fibrous properties to require a force of at least approximately 1.98 grams to displace a 7 inches by 1 ⅜ inches portion of the tape along the surface of a hard finish broad cloth, said tape having a pair of longitudinal edges, a first longitudinal line of said tape spaced from a longitudinal edge by an amount equal to a preselected seam width, a plurality of transverse lines normal to said longitudinal edges spaced apart by a unit of measurement and suitable for performing measurements along said edge, and a plurality of additional longitudinal lines on said tape having the same spacing as said transverse lines to form a pattern with said transverse lines having a plurality of rows of squares and suitable as a guide for decorative needlepoint sewing.

2. The tape according to claim 1 wherein said paper has a basis weight of between 28 and 32 pounds.

3. The tape according to claim 1 wherein said paper has shallow surface indentations, said indentations being of a depth to increase the exterior texture without altering the dimensional stability of the paper.

4. The tape according to claim 1 wherein said first longitudinal line is five-eighths of an inch from said first longitudinal edge.

5. The tape according to claim 1 wherein selected ones of said transverse lines are marked at intervals of units of measurement.

6. The tape according to claim 5 wherein said transverse lines have a predetermined length and said selected ones are greater on length.

7. The tape according to claim 1 wherein said first longitudinal line contains identifying characteristics which distinguish it from said additional longitudinal lines on said tape.

8. The tape according to claim 1 wherein said additional and transverse lines are so applied to said tape as to form a pattern of quarter inch squares.

9. The tape according to claim 1 wherein said strip of paper is formed of a pair of plies.

* * * * *